US008876014B2

(12) United States Patent
Zhang et al.

(10) Patent No.: US 8,876,014 B2
(45) Date of Patent: Nov. 4, 2014

(54) POLYURETHANE BALLAST LAYER, THE METHOD FOR PREPARING THE SAME AND THE USE THEREOF

(75) Inventors: Chenxi Zhang, Singapore (SG); Gang Sun, Minhang Shanghai (CN); Yi Shen, Shanghai (CN); Hui Zhao, Shanghai (CN)

(73) Assignee: Bayer MaterialScience AG (DE)

( * ) Notice: Subject to any disclaimer, the term of this patent is extended or adjusted under 35 U.S.C. 154(b) by 50 days.

(21) Appl. No.: 13/642,273

(22) PCT Filed: Apr. 18, 2011

(86) PCT No.: PCT/EP2011/056134

§ 371 (c)(1), (2), (4) Date: Feb. 22, 2013

(87) PCT Pub. No.: WO2011/131621

PCT Pub. Date: Oct. 27, 2011

(65) Prior Publication Data

US 2013/0140373 A1 Jun. 6, 2013

(30) Foreign Application Priority Data

Apr. 21, 2010 (CN) ..... 2010 1 0152756
May 21, 2010 (CN) ..... 2010 1 0181134

(51) Int. Cl.
*E01B 21/00* (2006.01)
*E01B 1/00* (2006.01)
*E01B 27/02* (2006.01)

(52) U.S. Cl.
CPC . *E01B 1/00* (2013.01); *E01B 27/02* (2013.01); *E01B 1/001* (2013.01)
USPC ..... 238/2; 238/382

(58) Field of Classification Search
USPC ..... 238/2
See application file for complete search history.

(56) References Cited

U.S. PATENT DOCUMENTS 3,656,690 A * 4/1972 Hanig ..... 238/2
3,756,507 A * 9/1973 Hanig et al. ..... 238/2

(Continued)

FOREIGN PATENT DOCUMENTS

DE 2305536 A1 8/1974
EP 1566478 A3 8/2006

OTHER PUBLICATIONS

International Search Report for PCT/EP2011/056134 mailed Sep. 7, 2011.

(Continued)

*Primary Examiner* — Jason C Smith
(74) *Attorney, Agent, or Firm* — Drinker Biddle & Reath LLP

(57) ABSTRACT

The present invention relates to a polyurethane ballast layer, the method for preparing the same and a railway comprising the polyurethane ballast layer. The polyurethane ballast layer provided in this invention comprises a polyurethane-filled ballast layer and a polyurethane external protective layer, wherein the polyurethane-filled ballast layer comprises ballasts and polyurethane foam filled in the space among the ballasts. The polyurethane ballast layer provided in this invention can reduce the probability of ballast crashing, shifting and cracking under heavy load, and separate the ballast track from the outside environment to prevent rain, snow and wastes from entering into the internal space of the ballast track bed. Furthermore, the polyurethane ballast layer can keep the polyurethane foam filled in the ballasts layer away from water in the outside environment to avoid hydrolysis. The polyurethane ballast layer presented in this invention can be used in the railway ballast track bed to extend the track bed maintenance cycle, and save maintenance cost significantly.

10 Claims, 1 Drawing Sheet

(56) References Cited

U.S. PATENT DOCUMENTS

| | | | | |
|---|---|---|---|---|
| 5,487,501 | A * | 1/1996 | Engst et al. | 238/2 |
| 6,354,512 | B2 * | 3/2002 | Vennell | 238/2 |
| 7,896,255 | B2 * | 3/2011 | Frenzel | 238/2 |
| 2007/0172590 | A1 * | 7/2007 | Hoffmann et al. | 427/212 |
| 2008/0173724 | A1 * | 7/2008 | Frenzel | 238/2 |
| 2009/0152368 | A1 * | 6/2009 | Frenzel | 238/2 |
| 2010/0140367 | A1 * | 6/2010 | Pawlik et al. | 238/2 |
| 2013/0062423 | A1 * | 3/2013 | Zhang et al. | 238/2 |
| 2013/0140373 | A1 * | 6/2013 | Zhang et al. | 238/2 |

OTHER PUBLICATIONS

International Preliminary Report on Patentability of PCT/EP2011/056134.

* cited by examiner

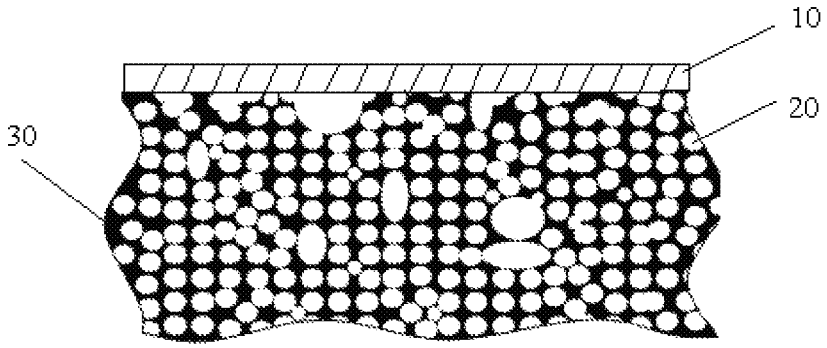
10
20
30

POLYURETHANE BALLAST LAYER, THE METHOD FOR PREPARING THE SAME AND THE USE THEREOF

CROSS-REFERENCE TO RELATED APPLICATIONS

This application is a national stage application (under 35 U.S.C. §371) of PCT/EP2011/056134, filed Apr. 18, 2011, which claims benefit of Chinese Application No. 201010152756, filed Apr. 21, 2010, and Chinese Application No. 201010181134, filed May 21, 2010, all of which are incorporated herein by reference in their entirety.

TECHNICAL FIELD

The present invention relates to polyurethane, especially related to a polyurethane ballast layer, the method for preparing the same, and a railway or a railway track bed comprising the polyurethane ballast layer.

BACKGROUND ART

The railway track bed, a ballast layer set above the road base and below the rail and sleeper, is a base of a railway frame. The railway track bed is used to support the rail and sleeper, equally distribute the heavy train load from the rail and sleepers onto the road base, reduce the distortion of the road base, and guarantee the safety of the transportation. Further, the ballasts possess a function of impact reduction and shock absorption. The ballast railway track bed possesses a wide range of application, because of its universal use and low construction cost.

The maintenance cost of the ballast railway track bed is very high. Apart from the regular maintenance, it is necessary to maintain the railway track bed in downtime by using of big maintenance equipments. During the service time, the position of the ballasts in the track bed structure is changed, due to the vibration from the rail and sleeper. Furthermore, the sharp edge of the ballast is gradually rubbed, and then becomes powder.

In addition, due to the ballast space structure, it is hard to avoid the coal, dust, sand and waste in the external environment enter into the ballast track bed to cause compaction. Even worse, the sleeper or rail might be broken, if the ballast track bed sink or liquidize to slurry.

In the prior art, there are many methods being used to reinforce ballast track bed by using of polymer material. For example, US2007172590 discloses a method for preparing a ballast track bed, wherein the ballast track bed comprises ballast stones and polyurethane foam, the polyurethane foam is obtained by the reaction between polyisocyanate and isocyanate-reactive compound. In addition, DE2305536A discloses a method to reinforce ballast track bed by pouring a polyurethane foaming material into the ballast space, foaming and curing.

However, the polyols used in the previous methods are limited to polyether polyol, because polyurethane foam based on polyester polyol is easy to hydrolysis, the mechanical properties reduce significantly after hydrolysis, therefore, the maintenance cycle of the ballast track bed is reduced significantly to avoid severe safety issues with regard to railway transportation.

CONTENT OF THE INVENTION

An object of the invention is to provide a method for preparing a polyurethane ballast layer. According to an example of the present invention, the method comprises the steps of: spraying a first reaction system including the following components onto a surface of a polyurethane-filled ballast layer to form a polyurethane external protective layer, 1a) one or more polyisocyanates having a general formula $R(NCO)_n$, wherein, R is an aliphatic alkyl group comprising 2-18 carbon atoms, an aromatic alkyl group comprising 6-15 carbon atoms or an arylated alkyl group comprising 8-15 carbon atoms, n=2-4;

1b) one or more polyether polyols and/or amine terminated polyether, having an average molecular weight more than 200 and a functionality 2-6;

1c) one or more extender; and 1d) 0-0.5% by weight of one or more blowing agent, based on 100% by weight of 1b and 1c;

wherein the tensile strength of said molding polyurethane layer is 4-20 MPa.

Preferably, the density of the polyurethane external protective layer is 0.6-1.5 g/cm3, the hardness of the polyurethane external protective layer is 10-90 Shore A, and elongation at break of said polyurethane external protective layer is 100-550%.

Preferably, the polyurethane-filled ballast layer comprises ballasts and polyurethane foam filled among the ballasts, the polyurethane foam comprises a reaction product of a second reaction system including the reaction components of 2a) one or more polyisocyanates having a general formula R(NCO)n, wherein, R is an aliphatic alkyl group comprising 2-18 carbon atoms, an aromatic alkyl group comprising 6-15 carbon atoms or an arylated alkyl group comprising 8-15 carbon atoms, n=2-4;

2b) one or more polyols, wherein said polyol is selected from the group consisting of polyether polyol, polyester polyol, polycarbonate polyol, polycaprolactone polyol and polytetrahydrofuran polyol;

2c) one or more extender; and 2d) 0.3-4.5% by weight of one or more blowing agent, based on 100% by weight of 2b and 2c;

wherein elongation at break of said polyurethane foam is 120-400%.

Preferably, the polyurethane foam is 0.02-0.5 g/cm3, the hardness of said polyurethane foam is 5-60 Asker C, and the tensile strength of said polyurethane foam is 0.2-5 MPa.

Another object of the invention is to provide a polyurethane ballast layer. According to an example of the present invention, the polyurethane ballast layer comprises a polyurethane-filled ballast layer and a polyurethane external protective layer, the polyurethane external protective layer comprises a reaction product of a first reaction system including the following reaction components, the first reaction system is sprayed onto a surface of said polyurethane-filled ballast layer, 1a) one or more polyisocyanates having a general formula R(NCO)n, wherein, R is an aliphatic alkyl group comprising 2-18 carbon atoms, an aromatic alkyl group comprising 6-15 carbon atoms or an arylated alkyl group comprising 8-15 carbon atoms, n=2-4;

1b) one or more polyether polyols and/or amine terminated polyether, having an average molecular weight more than 200 and a functionality 2-6;

1c) one or more extender; and 1d) 0-0.5% by weight of one or more blowing agent, based on 100% by weight of 1b and 1c;

wherein the tensile strength of said molding polyurethane layer is 4-20 MPa.

Preferably, the density of said polyurethane external protective layer is 0.6-1.5 g/cm3, the hardness of said polyurethane external protective layer is 10-90 Shore A, and elongation at break of said polyurethane external protective layer is 100-550%.

Preferably, the polyurethane-filled ballast layer comprises ballasts and polyurethane foam filled among the ballasts, the polyurethane foam comprises a reaction product of a second reaction system including the reaction components of 2a) one or more polyisocyanates having a general formula R(NCO)n, wherein, R is an aliphatic alkyl group comprising 2-18 carbon atoms, an aromatic alkyl group comprising 6-15 carbon atoms or an arylated alkyl group comprising 8-15 carbon atoms, n=2-4;

2b) one or more polyols, wherein said polyol is selected from the group consisting of polyether polyol, polyester polyol, polycarbonate polyol, polycaprolactone polyol and polytetrahydrofuran polyol;

2c) one or more extender; and 2d) 0.3-4.5% by weight of one or more blowing agent, based on 100% by weight of 2b and 2c;

wherein elongation at break of said polyurethane foam is 120-400%.

Preferably, the polyurethane foam is 0.02-0.5 g/cm3, the hardness of said polyurethane foam is 5-60 Asker C, and the tensile strength of said polyurethane foam is 0.2-5 MPa.

Another object of the invention is to provide a railway bed, comprising a polyurethane ballast layer provided in this invention and a railway road bed, the polyurethane ballast layer is set on the railway road bed.

Another object of the invention is to provide a use of the polyurethane ballast layer provided in this invention in constructing a railway bed.

The polyurethane ballast layer provided in this invention comprises a polyurethane-filled ballast layer and a polyurethane external protective layer, wherein the polyurethane-filled ballast layer comprises ballasts and polyurethane foam filled in the space among the ballasts. The polyurethane ballast layer provided in this invention can be used to fix the track bed ballast, reduce the probability of impact of ballast crashing, shifting and cracking under heavy load, separate the ballast track with the outside environment to avoid the rain, the snow and the waste enter into the internal space of the ballast track. Furthermore, the polyurethane ballast layer can be used to keep the polyurethane foam filled in the ballasts away from the water in the outside environment to avoid hydrolysis. The polyurethane ballast layer presented in this invention can be used in the railway ballast track bed to extend the track bed maintenance cycle, and save maintenance fees significantly.

DESCRIPTION OF THE DRAWINGS

The drawings are illustrative for the present invention and are by no means limiting.

FIG. 1 is a sketch of a polyurethane ballast layer presented in this invention.

MODE FOR CARRYING OUT THE INVENTION

The method for preparing the polyurethane ballast layer includes, pouring the second reaction system into the ballast space, foaming, and forming a polyurethane-filled ballast layer which comprises ballast and polyurethane foam, then spraying the first reaction system on the polyurethane-filled ballast layer surface to form a polyurethane external protective layer. The polyurethane ballast layer given by the invention can reduce the probability of ballast crashing, shifting and cracking under heavy load, separate the ballast track with outside environment, and avoid the rain, snow, waste enter ballast track, furthermore, it can prevent the water getting into the ballast space to avoid polyurethane hydrolysis in the ballast space. The polyurethane ballast layer given by the invention can be used in railway ballast track bed to extend the track bed maintenance cycle.

In addition, the ballast layer filled with polyurethane possesses good adhesion with the polyurethane external protective layer. The polyurethane ballast layer provided by the invention is an integrated whole structure.

The polyurethane ballast layer provided by the invention includes polyurethane external protective layer, so the second reaction system, which is used to prepare polyurethane filled ballast layer, can be selected from polyether system or polyol system in accordance with the requirements, such as polyester system, to achieve better physical and mechanical properties without worrying about the polyurethane hydrolysis issues caused by water; further more, if the second reaction system is selected from polyester polyol, polycaprolactone polyol or poly carbonate polyol, the polyurethane ballast layer will have excellent physical and mechanical properties, especially fit for heavy haul railway track bed. If the second reaction system is selected from PTMEG, the polyurethane ballast layer will have excellent physical and mechanical properties at low temperature, especially fit for the railway in cold area.

FIG. 1 is the cross section sketch map of polyurethane ballast layer provided by present invention. As shown in FIG. 1, pouring the second reaction system into the ballast 20, foaming, and forming a polyurethane foam filled ballast layer comprising ballast layer 20 and polyurethane foam 30, then spraying the first reaction system onto a surface of the polyurethane foam filled ballast layer to form a polyurethane external protective layer 10.

First Reaction System

The method for preparing the polyurethane ballast layer provided in the present invention includes spraying a first reaction system on a surface of polyurethane-filled ballast layer to form a polyurethane external protective layer.

In this invention, the first polyurethane reaction system can be selected from, but not limited to, single component, double components or multi components polyurethane reaction system, preferably double components polyurethane reaction system.

The double components polyurethane reaction system includes Component A1 mainly composing polyisocyanates and Component B1 mainly composed by polyols, amine terminated polyether polyols and chemical with isocyanate-reactive groups or their mixture.

The Component A1 comprises one or more polyisocyanates, the polyisocyanates can be represented by general formula, R(NCO)n, wherein R represents a (cyclo)aliphatic alkylene comprising 2-18 carbon atoms, or an aromatic alkylene comprising 6-15 carbon atoms, or a (cyclo)aliphatic aromatic alkylene comprising 8-15 carbon atoms, n=2-4.

The polyisocyanates can be selected from, but not limited to, ethylene diisocyanate, 1,4-tetramethylene diisocyanate, hexamethylene diisocyanate (HDI), 1,2-dodecane diisocyanate, cyclobutane-1,3-diisocyanate, cyclohexane-1,3-diisocyanate, cyclohexane-1,4-diisocyanate, 1-isocyanate-3,3,5-trimethyl-5-isocyanate cyclohexane, 2,4-hexahydro toluene diisocyanate, 1,3-hexahydro phenyl diisocyanate, 1,4-hexahydro phenyl diisocyanate, perhydrogenated diphenylmethane-2,4-diisocyanate, perhydrogenated diphenylmethane-4,4-diisocyanate, phenylene 1,3-diisocyanate, phenylene 1,4-diisocyanate, dureene-1,4-diisocyanate, 3,3-dimethyl-4,4-diphenyl diisocyanate, methyl-2,4-diisocyanate(TDI), methyl-2,6-diisocyanate(TDI), diphenylmethane-2,4'-diisocyanate(MDI), diphenylmethane-4,4'-diisocyanate (MDI), naphthylene-1,5-diisocyanate(NDI), their isomer, the mixtures thereof.

The polyisocyanates can also include polyisocyanates modified by carbon diamine, allophanate or isocyanate, such polyisocyanates can be selected from, but not limited to, diphenylmethane diisocyanate or diphenylmethane diisocyanate modified by carbon diamine, their isomer, the mixtures thereof.

The polyisocyanates can also include isocyanate prepolymer, the method of for preparing the isocyanate prepolymer is well-known in prior art. The NCO content of the prepolymer can be selected from, but not limited to, 2-18 wt. %, preferably 5-14 wt. %, more preferably 7-12 wt. %.

The Component B1 comprises polyether polyol, amine terminated polyether polyol or their mixture. Furthermore, the first reaction system can also include chain extender, filler and blowing agent.

The molecular weight of the polyether polyol is 200-8000, preferably 500-6000, the functionality is 2-6, preferably 2-4. The polyether polyol can be selected from, but not limited to, poly(propylene oxide) polyol, poly(ethylene oxide) polyol, PTMEG and their mixtures.

The amine terminated polyether polyol can be selected from, but not limited to, primary amine terminated polyether polyol, secondary amine terminated polyether polyol or their mixtures, the functionality of the amine terminated polyether polyol is 2-6, preferably 2-3. The molecular weight of the amine terminated polyether polyol molecular is equal to or more than 1000. The method for preparing the amine terminated polyether polyol is well-known in the prior art.

The chain extenders are typically selected from active hydrogen containing compound having a molecular weight less than 800, preferably 18-400. Such active hydrogen containing compound can be selected from, but not limited to, alkanediols, dialkylene glycols, and polyalkylene polyols. The examples are ethanediol, 1,4-butanediol, 1,6-hexanediol, 1,7-heptanediol, 1,8-octanediol, 1,9-nonanediol, 1,10-decanediol, diethylene glycol, dipropylene glycol, andpolyoxyalkylene glycols. Other suitable substances are branched chain and unsaturated alkanediols such as 1,2-propanediol, 2-methyl-1,3-propanediol, 2,2-dimethyl-1,3-propanediol, 2-butyl-2-ethyl-1,3-propanediol, 2-butene-1,4-diol and 2-butyne-1,4-diol, alkanolamines and N-alkyldialkanolamines such as ethanolamine, 2-aminopropanol and 3-amino-2,2-dimethylpropanol, N-methyl-diethanolamines, N-ethyl-diethanolamines, or their mixture. Such active hydrogen containing compound can also be selected from (cyclo) aliphatic, aromatic amines, or their mixtures, such as 1,2 ethylenediamine, 1,3-propylenediamine, 1,4-butylenediamine, 1,6-hexamethylenediamine, isophoronediamine, 1,4-cyclohexamethylenediamine, N,N'-diethyl-phenylenediamine, 2,4-diaminotolune, 2,6-diaminotolune, or their mixtures. The amount of the chain extender dosage is 5-60 wt. %, preferably 8-50 wt. %, more preferably 9-20 wt. %, based on 100 wt. % of Component B1.

The fillers can be selected from inorganic fillers or organic fillers. The inorganic fillers can be selected from, but not limited to, silicate, metal oxide, metal salt, inorganic dye, natural and synthetic fibre, nano material, or their mixture; the non-restrictive examples are calcium silicate, calcium carbonate, silicon dioxide, nano-zinc oxide, barite, zinc sulfide, glass particles, or wollastonite. The organic fillers can be selected from, but not limited to, paraffin wax, polymer polyol, organic particles, or cork. The inorganic filler or organic filler can be used alone or in combination. The fillers can not only improve the tensile strength of the polyurethane external protective layer, but also improve the flame retardancy thereof. The amount of the fillers dosage is 0-45 wt. %, preferably 0-25 wt. %, more preferably 0-20 wt. %, based on 100 wt. % of the Component B1.

The blowing agent can be selected from physical blowing agent or chemical blowing agent. The blowing agent can be selected from, but not limited to, water, halogenated hydrocarbon, or hydrocarbon. The halogenated hydrocarbon can be selected from, but not limited to, monochlorodifuloromethane, dichloromonofluoromethane, dichlorofluoromethane, trichlorofluromethane and the mixtures thereof or the mixtures thereof. The hydrocarbon can be selected from, but not limited to, butane, pentane, cyclopentane, hexane, cyclohexane, heptane and the mixtures thereof. Preferably, the blowing agent can be selected from water. The amount of the blowing agent depends on the desired density of the polyurethane filled ballast layer, preferably 0-0.5 wt. %, more preferably 0.03-0.3 wt. %, most preferably 0.05-0.25 wt. %, based on 100 wt. % of the polyols in the first reaction system (not only including the polyols used as the reaction component, but also including the polyols used as chain extender or the polyols used in other components).

The Component B1 can further comprise catalyst and surfactant.

The catalyst can be selected from, but not limited to, amine catalyst, organic metal catalyst, or their mixtures. The amine catalyst can be selected from, but not limited to, triethyl amine, tributyl amine, triethylene diamine, N-ethyl morpholine, N,N,N',N'-tetramethyl-ethylenediamine, pentamethyl diethylenetriamine amine, N,N-methyl aniline, N,N-dimethylaniline, or their mixtures. The organic metal catalyst can be selected from, but not limited to, organotin compound, such as stannous diacetate, stannous dioctoate, tin ethyl hexanoate, tin dilaurate, dibutyl tin oxide, dibutyl tin dichloride, dibutyl tin diacetate, dibutyl tin maleate, dioctyl tin diacetate, or their mixtures. The amount of the catalyst is 0.001-10 wt. %, based on 100 wt. % of the Component B1.

The surfactant can be selected from, but not limited to, ethylene oxide ramification of siloxanes. The amount of the surfactant is 0.01-5wt. %, based on 100 wt. % of the Component B1.

In the first reaction system, the molar ratio of the NCO group to OH and/or $NH_2$ group can be selected from, but not limited to, 70-130:100, preferably, 90-115:100, the OH and/or $NH_2$ group is based on the OH and/or $NH_2$ group comprised in polyol, chain extender, filler, blowing agent in Component B1.

The tensile strength of the polyurethane external protective layer is 4-20 MPa.

The density of the polyurethane external protective layer is 0.6-1.5 g/cm3. The hardness is 10-90 Shore A. Elongation at break of the polyurethane external protective layer is 100-550%.

Equipments for Spraying the First Reaction System

In this invention, the equipment for spraying the first reaction system can be selected from, but not limited to, single component spraying machine, double components spraying machine or multi components spraying machine, preferably double components spraying machine. The spraying machine can be selected from, high pressure spraying machine or low pressure spraying machine, the working pressure of the high pressure spraying machine is 100-300 bar, the working pressure of the low pressure spraying machine from about 5-50 bar.

The spraying equipment can be selected from, but not limited to, hand operate spraying gun with integrated mix head or automatic spraying gun with integrated mix head, preferably automatic spraying gun with integrated mix head. The spray material is transported to the spraying gun by pipeline, the material is mixed in spraying gun before being sprayed out.

The spraying equipment can be selected from, but not limited to, fixed volume ratio of the spraying equipment, or non-fixed volume spraying equipment; when using fixed volume ratio of the spraying equipment, the volume ratio of Component A1 mainly comprising isocyanates to the Component B1 mainly comprising polyols, can be selected from, but not limited to, 3:1, 2:1, 1:1, 1:2, 1:3, or other fixed ratio; when using non-fixed volume ratio of the spraying equipment, the volume ratio of Component A1 mainly comprising isocyanates to the Component B1 mainly comprising polyols, can be selected from, but not limited to, 10:100-100:10. The spraying equipment, can further include a heating device, wherein the heating device can be set in the raw material tank, or on the raw material pipeline.

Second Reaction System

According to the method for preparing the polyurethane ballast layer provided in the present invention, a second reaction system is poured into the space among the ballast, foaming and forming a polyurethane-filled ballast layer comprising ballasts and polyurethane foam.

The second polyurethane reaction system single component can be selected from, but not limited to, single component, double components and multi components polyurethane reaction system, preferably double component polyurethane reaction system.

The double component polyurethane reaction system includes Component A2 mainly composing polyisocyanates and Component B2 mainly composing polyols.

The Component A2 comprises one or more polyisocyanates, the polyisocyanates can be represented by a general formula, R(NCO)n, wherein R represents a (cyclo)aliphatic alkylene comprising 2-18 carbon atoms, or an aromatic alkylene comprising 6-15 carbon atoms, or a (cyclo)aliphatic aromatics alkylene consisting of 8-15 carbon atoms, n=2-4.

The polyisocyanates can be selected from, but not limited to, ethylene diisocyanate, 1,4-tetramethylene diisocyanate, hexamethylene diisocyanate, 1,2-dodecane diisocyanate, cyclobutane-1,3-diisocyanate, cyclohexane-1,3-diisocyanate, cyclohexane-1,4-diisocyanate, 1-isocyanate-3,3,5-trimethyl-5-isocyanate cyclohexane, 2,4-hexahydro toluene diisocyanate, 1,3-hexahydro phenyl diisocyanate, 1,4-hexahydro phenyl diisocyanate, perhydrogenated diphenylmethane-2,4-diisocyanate, perhydrogenated diphenylmethane-4,4-diisocyanate, phenylene 1,3-diisocyanate, phenylene 1,4-diisocyanate, dureene-1,4-diisocyanate, 3,3-dimethyl-4,4-diphenyl diisocyanate, methyl-2,4-diisocyanate(TDI), methyl-2,6-diisocyanate(TDI), diphenylmethane-2,4'-diisocyanate(MDI), diphenylmethane-4,4'-diisocyanate (MDI), naphthylene-1,5-diisocyanate(NDI), the mixtures thereof, their isomer, their mixtures.

The polyisocyanate can also include polyisocyanate modified by carbon diamine, allophanate or isocyanate; such polyisocyanates can be selected from, but not limited to, diphenylmethane diisocyanate or diphenylmethane diisocyanate modified by carbon diamine, their isomer, their mixtures.

The polyisocyanates, can also include isocyanate prepolymer, the method of for preparing the isocyanate prepolymer is well-known in prior art. The NCO content of the prepolymer can be selected from, but not limited to, 8-30 wt. %, preferably 10-28 wt. %.

The Component B2 mainly comprises polyol, chain extender, fillers and blowing agent.

The polyol can be selected from, but not limited to, polyester polyol, polyether polyol, polycarbonate polyol, PTMEG polyol, polycaprolactone polyol and their mixtures.

The polyester polyols may be produced from the reaction of organic dicarboxylic acids or dicarboxylic acid anhydrides with polyhydric alcohols. The dicabrboxylic acids can be selected from, but not limited to, aliphatic carboxylic acids containing 2 to 12 carbon atoms, for example, succinic acid, malonic acid, glutaric acid, adipic acid, suberic acid, azelaic acid, sebacic acid, decane-dicarboxylic acid, maleic acid, fumaric acid, phthalic acid, isophthalic acid, and terephthalic acid. The dicarboxylic acids can be selected from, but not limited to, phthalic anhydride, terachlorophthalic anhydride, maleic anhydride, or their mixtures. The polyol can be selected from, but not limited to, ethanediol, diethylene glycol, 1,2-and 1,3-propanediols, dipropylene glycol, 1,3-methylpropanediol, 1,4 butanediol, 1,5-pentanediol, 1,6-hexanediol, neopentyl glycol, 1,10-decanediol, glycerol, trimethylol-propane, or their mixtures.

The polyester polyol, can also include polyester polyol made by lactones. The polyester polyol made by lactones, can be selected from, but not limited to, ϵ-caprolactone.

The polyester polyols can be produced by prior art, for example, by a reaction of olefin oxides and initiators in the present of catalysts. The catalyst can be selected from, but not limited to, alkaline hydroxide, alkaline alkoxide, antimony pentachloride, boron trifluoride diethyl ether, or their mixtures. The olefin oxide can be selected from, but not limited to, tetrahydrofuran, ethylene oxide, 1,2-propylene oxide, 1,2-epoxy butane, 2,3-epoxy butane, styrene oxide, or their mixtures. The initiator can be selected from, but not limited to, polyols, such as water, ethylene glycol, 1,2-propanediol, 1,3-propanediol, diethylene glycol, trimethylolpropane, or their mixtures The polycarbonate polyol can be selected from, but not limited to, polycarbonate diols. The polycarbonate diols can be prepared by diols and dialkyl or diaryl carbonate or phosgene. The diols can be selected from, but not limited to, 1,2-propanediol, 1,3-propanediol, 1,4-butanediol, 1,5-pentanediol, 1,6-hexanediol, diethylene glycol, trioxane diol, or their mixtures. The dialkyl or diaryl carbonate, can be selected from, but not limited to, diphenyl carbonate.

The average molecular weight of the PTMEG polyol can be selected from, but not limited to 200-4000, preferably 500-3000; the functionality of the PTMEG polyol can be selected from, but not limited to 2-6, preferably 2-3.

The chain extenders, are typically selected from active hydrogen atom containing compounds having a molecular weight less than 800, preferably 18-400. the active hydrogen atom containing compounds can be selected from, but not limited to alkanediols, dialkylene glycols, and polyalkylene polyols, or their mixtures, such as ethanediol, 1,4-butanediol, 1,6-hexanediol, 1,7-heptanediol, 1,8-octanediol, 1,9-nonanediol, 1,10-decanediol, diethylene glycol, dipropylene glycol, polyoxyalkylene glycols, their or their mixtures. The active hydrogen atom containing compounds can also include branched chain and unsaturated alkanediols or the mixtures thereof, for example, 1,2-propanediol, 2-methyl-1,3-propanediol, 2,2-dimethyl-1,3-propanediol, 2-butyl-2-ethyl-1,3-propanediol, 2-butene-1,4-diol, 2-butyne-1,4-diol, alkanolamines and N-alkyldialkanolamines such as ethanolamine, 2-aminopropanol and 3-amino-2,2-dimethylpropanol, N-methyl diethanolamines, N-ethyl-diethanolamines, or their mixtures. The active hydrogen atom containing compounds can also include aliphatic amines, aromatic amines, or their mixtures, such as 1,2-ethylenediamine, 1,3-propylenediamine, 1,4-butylenediamine, 1,6-hexamethylenediamine, isophoronediamine, 1,4-cyclohexamethylenediamine, N,N'-diethylphenylenediamine, 2,4-diaminotolune, 2,6-diaminotolune, or their mixtures. The amount of the chain extenders is 5-60 wt. %, preferably 8-50 wt. %, more preferably 9-20 wt. %, based on 100 wt. % of Component B2.

The fillers can be selected from inorganic fillers or organic fillers. The inorganic fillers can be selected from, but not limited to, silicate, metal oxide, metal salt, inorganic dye, natural fiber, synthetic fiber, nano material, or their mixtures, the non-limitative examples are calcium silicate, calcium carbonate, silicon dioxide, nano-zinc oxide, barite, zinc sulfide, glass particles, wollastonite. The organic fillers can be selected from, but not limited to, paraffin wax, polymer polyol, organic particles, or cork. The inorganic filler or organic filler can be used independently or by mixture. The fillers can improve the tensile strength, flame retardancy or other properties of the polyurethane external protective layer. The amount of the fillers is 0-45 wt. %, preferably 0-25 wt. %, more preferably 0-20 wt. %, based on 100 wt. % of Component B2.

The blowing agent can be selected from physical blowing agent or chemical blowing agent, such as water, halohydrocarbon andhydrocarbo. The halohydrocarbon can be selected from, but not limited to, monochlorodifuloromethane, dichloromonofluoromethane, dichlorofluoromethane, trichlorofluromethane, or their mixtures. The hydrocarbon can be selected from, but not limited to, butane, pentane, cyclopentane, hexane, cyclohexane, heptane, or their mixtures. Preferably, the blowing agent can be selected from water. The amount of the blowing agent depends on the desired density of the polyurethane filled ballast layer, preferably 0.3-4.5 wt. %, more preferably 0.5-3.6 wt. %, most preferably 0.6-3.2 wt. %, based on 100 wt. % of the polyols in the second reaction system (not only including the polyols used as the reaction component, but also including the polyols used as chain extender or the polyols used in other components).

The Component B2 can further comprise catalyst and surfactant.

The catalyst can be selected from, but not limited to, amine catalyst, organic metal catalyst, or their mixtures. The amine catalyst can be selected from, but not limited to, triethyl amine, tributyl amine, triethylene diamine, N-ethyl morpholine, N,N,N',N'-tetramethyl-ethylenediamine, pentamethyl diethylenetriamine amine, N,N-methyl aniline, N,N-dimethylaniline, or their mixtures. The organic metal catalyst can be selected from, but not limited to, organotin compound, such as stannous diacetate, stannous dioctoate, tin ethyl hexanoate, tin dilaurate, dibutyl tin oxide, dibutyl tin dichloride, dibutyl tin diacetate, dibutyl tin maleate, or dioctyl tin diacetate, their mixtures. The amount of the catalyst is 0.001-10 wt. %, based on 100 wt. % of the Component B2.

The surfactant can be selected from, but not limited to, ethylene oxide ramification of siloxanes. The amount of the surfactant is 0.01-5 wt. %, based on 100 wt. % of the Component B2.

In the second reaction system, the molar ratio of the NCO group to OH and/or NH2 group can be selected from, but not limited to, 70-130:100, preferably, 90-115:100, the OH and/or NH2 group is based on the OH and/or NH2 group comprised in polyol, chain extender, filler, blowing agent in Component B2.

The density of the polyurethane foam in the ballast space is 0.02-0.5 g/cm$^3$, preferably 0.05-0.4 g/cm$^3$, more preferably 0.1-0.3 g/cm$^3$. The hardness of the polyurethane foam in the ballast space is 5-60 Asker C, preferably 10-40 Asker C. The elongation at break of the polyurethane-filled ballast layer is 120-400%.

Equipments for Pouring the Second Reaction System

In this invention, the equipment for pouring the second reaction system can be selected from, but not limited to, single component pouring machine, double components pouring machine or multi components pouring machine, preferably double components pouring machine. The pouring machine can be selected from, high pressure pouring machine or low pressure pouring machine, the working pressure of the high pressure pouring machine is 100-300 bar, the working pressure of the low pressure pouring machine from about 5-50 bar.

The pouring machine can be selected from, but not limited to, hand operate pouring gun with integrated mix head or automatic pouring gun with integrated mix head. Usually, the raw material is transported to the pouring gun by pipes. The raw material is pouring after being mixed in the pouring gun.

The pouring machine can be selected from, but not limited to, the pouring machine with fixed volume ratio or unfixed volume ratio; When using the pouring machine with fixed volume ratio, the volume ratio of the Component A2 mainly comprising isocyanates to the Component B2 mainly comprising polyols can be selected from, but not limited to, 3:1, 2:1, 1:1, 1:2, 1:3, or other fixed volume ratio; When using the pouring machine with unfixed volume ratio, the volume ratio of the Component A2 mainly comprising isocyanates to the Component B2 mainly comprising polyols can be selected 10:100-100:10.

The output of the pouring machine can be selected from, but not limited to, 20-5000 g/s.

EXAMPLES

The examples and the methods disclosed in this invention are illustrative rather than restrictive.

Description of Raw Materials Desmodur PF: isocyanate prepolymer, NCO %: 23.0%, viscosity: 600 mPa·s 25° C., available from Bayer MaterialScience Company.

Desmodur PA09: isocyanate prepolymer, NCO %: 24.5%, viscosity: 475 mPa·s 25° C., available from Bayer MaterialScience Company.

Desmodur K630: isocyanate prepolymer, NCO %: 15%, viscosity: 850 mPa·s 25° C., available from Bayer MaterialScience Company.

Desmodur 0926: isocyanate prepolymer, NCO %: 19.9%, viscosity: 1390 mPa·s 20° C., available from Bayer MaterialScience Company.

Desmodur 0309: isocyanate prepolymer, NCO %: 9.9%, viscosity: 2750 mPa·s 25° C., available from Bayer MaterialScience Company.

BAYTEC 0310: polyether polyol spraying system, OH: 94, Viscosity 2050 mPa·s 25° C., available from Bayer MaterialScience Company.

BAYTEC 0357: polyether polyol spraying system, OH: 157, Viscosity 2100 mPa·s 25° C., available from Bayer MaterialScience Company.

BAYTEC 52BC003: polyether polyol spraying system, OH: 205, Viscosity 1100 mPa·s 25° C., available from Bayer MaterialScience Company.

Terathane 2000: PTMEG, OH number: 56, Viscosity: 1200 mPa·s 40° C., available from Bayer MaterialScience Company.

Bayflex CE 8070: chain extender, OH: 1598, viscosity 18 mPa·s 20° C., available from Bayer MaterialScience Company.

Bayflex CE 8075: chain extender, OH: 1610, viscosity 20 mPa·s 20° C., available from Bayer MaterialScience Company.

Desmophen 2003E: polyester polyol system, OH number: 56, viscosity: 560mPa·s 75° C., available from Bayer MaterialScience Company.

Bayflex 12BX012: polyether polyol system, OH: 102, viscosity: 1050 mPa·s 25° C., available from Bayer MaterialScience Company.

Dabco 33LV: diamine catalyst, available from Air Products.

DABCO DC193: surfactant, available from Air Products.

Solkane 365/227: Blowing agent, available from Solvay Fluor Und Derivate GmbH.

HK 1250 type regular high pressure pouring machine: available from Hennecke.

H-XP3 type regular high pressure spraying machine: available from GRACO.

The invention will be further discribed as follows:

Example 1

The ballasts were piled in accordance with the requirement of the ballast railway bed. By using of HK 1250 type regular high pressure pouring machine, a second reaction system components comprising Desmodur PA09 and Bayflex 12BX012 were poured into the packed structure of the ballast in 40 seconds according to the amounts listed in the Table 1-1, foamed, cured in 30 minutes, and formed a polyurethane filled ballast layer.

TABLE 1-1

| Item | Unit | Material speciality/test standard | Formula 1-1 | Formula 1-2 |
|---|---|---|---|---|
| Bayflex 12BX012 | weight parts | Temperature 25-30° C. | 100 | 100 |
| Desmodur PA 09 | weight parts | Temperature 25-30° C. | 44 | 44 |
| Solkane ® 365/227 | weight parts | Pre-mixed in 12BX012 | 4 | 0 |
| Physical properties | | | | |
| Foam density | kg/m3 | DIN EN ISO 845 | 200 | 300 |
| Hardness | Shore A | DIN 53505 | 39 | 59 |
| Tensile strength | KPa | DIN EN ISO 527 | 372 | 831 |
| Elongation at break | % | DIN EN ISO 527 | 125 | 134 |
| Tear strength | kN/m | DIN 53515 | 5.9 | 7.7 |
| Compress strength (10%) | KPa | DIN EN ISO 178 | 17 | 61 |
| Flexural strength (30° C.) | MPa | DIN EN ISO 178 | 0.52 | 1.08 |
| Flexural strength (−40° C.) | KPa | DIN EN ISO 178 | 90.2 | 133.9 |
| Brittleness | ° C. | Temperature at sample break 50% | −29 | −30 |

By using of H-XP3 type regular high pressure spraying machine, a first reaction system components comprising DESMODUR 0309 and BAYTEC 0310 were poured onto a surface of the polyurethane-filled ballast layer in 30 seconds according to the amounts listed in the Table 1-2, cured in 10 minutes, and formed a polyurethane external protective layer. The physical and mechanical properties of the polyurethane external protective layer were listed in Table 1-2.

TABLE 1-2

| Item | Unit | Material speciality/test standard | Formula 1-3 | Formula 1-4 |
|---|---|---|---|---|
| BAYTEC 0310 | volume parts | 23° C. | 100 | — |
| BAYTEC 0357 | volume parts | 23° C. | — | 100 |
| Desmodur 0309 | volume parts | 23° C. | 74 | 124 |
| Physical properties | | | | |
| Density | $kg/m^3$ | DIN EN ISO 845 | 900 | 900 |
| Hardness | Shore A | DIN 53505 | 73 | 83 |
| 100% Tensile strength | MPa | DIN EN ISO 527 | 4 | 5 |
| 300% Tensile strength | MPa | DIN EN ISO 527 | 7 | 10 |
| Tensile strength | MPa | DIN EN ISO 527 | 10 | 15 |
| Elongation at break | % | DIN EN ISO 527 | 350 | 370 |
| Tear strength | kN/m | DIN 53515 | 13 | 24 |
| Resilience | % | DIN 53512 | 45 | 35 |

The prepared polyurethane ballast layer comprised a polyurethane-filled ballast layer and polyurethane external protective layer.

The polyurethane-filled ballast layer was obtained by a foaming process of the polyether polyol system. The ballasts were fixed in the polyether polyurethane foam. The polyurethane-filled ballast layer possessed good physical and mechanical properties. The polyurethane external protective layer could separate the polyurethane-filled ballast layer with the outside environment, and significantly reduced the water immersion probabilities of the polyether polyurethane foam comprised in the polyurethane filled ballast layer. Furthermore, the polyurethane-filled ballast layer was well adhered to the polyurethane external protective layer, due to the fact that the chemical properties of the first reaction system was close to the second reaction system. Therefore, the obtained polyurethane ballast layer was an integrated whole structure.

The polyurethane ballast layer could be used to extend the maintenance cycle of the ballast track bed, because it possessed a good physical and mechanical properties, good stability and durability. In particular, the polyurethane ballast layer provided in Example 1 was suitable for the railway track bed in the high humidity area.

Example 2

The ballasts were piled in accordance with the requirement of the ballast railway bed. By using of HK 1250 type regular high pressure pouring machine, a second reaction system components were poured into the packed structure of the ballast in 50 seconds according to the amounts listed in the Table 2-1, foamed, cured in 20 minutes, and formed a polyurethane filled ballast layer. The physical and mechanical properties of the polyurethane-filled ballast layer were listed in the Table 2-1.

TABLE 2-1

| Item | Unit | Material speciality/test standard | Formula 2-1 | Formula 2-2 |
|---|---|---|---|---|
| Desmophen 2003E | weight parts | Temperature 30-40° C. | 100 | 100 |
| Desmodur 0926 | weight parts | Temperature 30-40° C. | 115 | 115 |
| Bayflex CE 8070 | weight parts | Temperature 30-40° C. | 17 | — |
| Bayflex CE 8075 | weight parts | Temperature 30-40° C. | — | 15 |
| Physical properties | | | | |
| Density | $kg/m^3$ | DIN EN ISO 845 | 250 | 450 |
| Hardness | Shore A | DIN 53505 | 40 | 65 |
| Tensile strength | MPa | DIN EN ISO 527 | 2.1 | 5.5 |
| Elongation at break | % | DIN EN ISO 527 | 380 | 400 |
| Tear strength | kN/m | DIN 53515 | 2.9 | 7 |

By using of H-XP3 type regular high pressure spraying machine, a first reaction system components comprising DESMODUR K630 and BAYTEC52BC003 were sprayed onto a surface of the polyurethane-filled ballast layer in 30 seconds according to the amounts listed in the Table 2-2, cured in 5 minutes, and formed a polyurethane external protective layer. The physical and mechanical properties of the polyurethane external protective layer were listed in Table 2-2.

TABLE 2-2

| Item | Unit | Material speciality/ test standard | Formula 2-3 | Formula 2-4 |
|---|---|---|---|---|
| BAYTEC 0310 | volume parts | Temperature 23° C. | 100 | — |
| BAYTEC 0357 | volume parts | Temperature 23° C. | — | 100 |
| Desmodur 0309 | volume parts | Temperature 23° C. | 74 | 124 |
| Physical properties | | | | |
| Density | $kg/m^3$ | DIN EN ISO 845 | 900 | 900 |
| Hardness | Shore A | DIN 53505 | 73 | 83 |
| 100% Tensile strength | MPa | DIN EN ISO 527 | 4 | 5 |
| 300% Tensile strength | MPa | DIN EN ISO 527 | 7 | 10 |
| Tensile strength | MPa | DIN EN ISO 527 | 10 | 15 |
| Elongation at break | % | DIN EN ISO 527 | 350 | 370 |
| Tear strength | kN/m | DIN 53515 | 13 | 24 |
| Resilience | % | DIN 53512 | 45 | 35 |

In Example 2, the polyester polyol system was used as a second polyurethane reaction system to prepare the polyurethane filled ballast layer, the density of the polyurethane-filled ballast layer was 250 kg/m$^3$, the tensile strength of the polyurethane-filled ballast layer was 2.1 MPa. Which means the physical properties of the polyurethane-filled ballast layer made by polyester polyol system was significantly higher than the polyurethane-filled ballast layer made by polyether polyol foam system (the density of the polyurethane-filled ballast layer polyurethane made by polyester polyol system was 300 kg/m$^3$, the tensile strength the polyurethane-filled ballast layer polyurethane made by polyester polyol system was 0.83 MPa). In particular, the polyurethane ballast layer provided in Example 2 was suitable for the railway track bed in heavy haul railway track bed or the railway track bed in desert area.

The prepared polyurethane ballast layer comprised a polyurethane-filled ballast layer and polyurethane external protective layer. The polyurethane-filled ballast layer was obtained by a foaming process of the polyester polyol system. The ballasts were fixed in the polyether polyurethane foam. The polyurethane-filled ballast layer possessed good physical and mechanical properties. The polyurethane external protective layer could separate the polyurethane-filled ballast layer with the outside environment, and significantly reduced the water immersion probabilities of the polyether polyurethane foam comprised in the polyurethane filled ballast layer. Furthermore, the polyurethane-filled ballast layer was well adhered to the polyurethane external protective layer, due to the fact that the chemical properties of the first reaction system was close to the second reaction system. Therefore, the obtained polyurethane ballast layer was an integrated whole structure.

Example 3

The ballasts were piled in accordance with the requirement of the ballast railway bed. By using of HK 1250 type regular high pressure pouring machine, a second reaction system components were poured into the packed structure of the ballast in 50 seconds according to the amounts listed in the Table 3-1, foamed, cured in 20 minutes, and formed a polyurethane filled ballast layer. The physical and mechanical properties of the polyurethane external protective layer were listed in Table 3-1.

TABLE 3-1

| Item | Unit | Material speciality/ test standard | Formula 3-1 |
|---|---|---|---|
| Terathane 2000 | weight parts | Temperature 30-40° C. | 92.75 |
| 1,4-butanediol | weight parts | Temperature 30-40° C. | 6 |
| 33LV | weight parts | Temperature 30-40° C. | 1 |
| Water | weight parts | Temperature 30-40° C. | 0.15 |
| Desmodur PF | weight parts | Temperature 30-40° C. | 46 |
| Physical properties | | | |
| Foam density | kg/m$^3$ | DIN EN ISO 845 | 300 |
| Hardness | Shore A | DIN 53505 | 59 |
| Tensile strength | MPa | DIN EN ISO 527 | 1.3 |
| Elongation at break | % | DIN EN ISO 527 | 400 |
| Tear strength | kN/m | DIN 53515 | 10 |
| Compress strength (10%) | MPa | DIN EN ISO 178 | 1.8 |
| Flexural strength (30) | MPa | DIN EN ISO 178 | 3.8 |
| Flexural strength (−40) | ° C. | Temperature at sample break 50% | −70 |

In Example 3, PTMEG system was used as a second polyurethane reaction system to prepare the polyurethane filled ballast layer. The density of the polyurethane-filled ballast layer was 300 kg/m$^3$, the tensile strength of the polyurethane-filled ballast layer polyurethane was 1.3 MPa. Which means the physical properties of the polyurethane-filled ballast layer made by PTMEG system was significantly higher than the polyurethane-filled ballast layer made by regular polyether polyol foam system.

When the temperature decreased from +30° C. to −40° C., the polyurethane flexural strength change from 1.8 to 3.8 MPa, which means the polyurethane still remain in high resilience state; The temperature of sample break 50% at low temperature is −70° C. (If regular polyether polyol was used to prepare the polyurethane filled ballast layer, the polyurethane density was 300 kg/m$^3$ , the tensile strength was 0.83 MPa; when temperature decreased from +30° C. to −40° C., the flexural strength of the polyurethane changed from 1.8 to 133.9 MPa, the polyurethane was changed from a high resilience state to a high stiffness plastic state, the temperature of sample break 50% at low temperature was −30° C.). The polyurethane-filled ballast layer prepared by a second reaction system based on PTMEG system possessed excellent physical properties under low temperature. The polyurethane-filled ballast layer prepared by a second reaction system based on PTMEG system was suitable to be used in railway track bed in high altitude and cold area or in heavy haul railway track bed.

By using of H-XP3 type regular high pressure spraying machine, a first reaction system components comprising DESMODUR K630 and BAYTEC 52BC003 were sprayed onto a surface of the polyurethane-filled ballast layer in 30 seconds according to the amounts listed in the Table 3-2, cured in 5 minutes, and formed a polyurethane external protective layer. The physical and mechanical properties of the polyurethane external protective layer were listed in Table 3-2.

TABLE 3-2

| Item | Unit | Material speciality/ test standard | Formula 3-2 |
|---|---|---|---|
| BAYTEC 52BC003 | volume parts | Temperature 25° C. | 100 |
| Desmodur K630 | volume parts | Temperature 25° C. | 100 |
| Physical properties | | | |
| Density | kg/m$^3$ | DIN EN ISO 845 | 950 |
| Hardness | Shore A | DIN 53505 | 95 |
| Tensile strength | MPa | DIN EN ISO 527 | 16.5 |
| Elongation at break | % | DIN EN ISO 527 | 500 |
| Tear strength | kN/m | DIN 53515 | 86 |
| Resilience | % | DIN 53512 | 35 |

The prepared polyurethane ballast layer comprised a polyurethane-filled ballast layer and polyurethane external protective layer.

The polyurethane-filled ballast layer was obtained by a foaming process of the PTMEG system. The ballasts were fixed in the polyether polyurethane foam. The polyurethane-filled ballast layer possessed good physical and mechanical properties. The polyurethane external protective layer could separate the polyurethane-filled ballast layer with the outside environment, and significantly reduced the water immersion probabilities of the polyether polyurethane foam comprised in the polyurethane filled ballast layer. Furthermore, the polyurethane-filled ballast layer was well adhered to the polyurethane external protective layer, due to the fact that the chemical properties of the first reaction system was close to the second reaction system. Therefore, the obtained polyurethane ballast layer was an integrated whole structure.

Example 4

The ballasts were piled in accordance with the requirement of the ballast railway bed. By using of HK 1250 type regular high pressure pouring machine, a second reaction system components DESMODUR PA 09 and BAYFLEX 12BX012 were poured into the packed structure of the ballast in 40 seconds according to the amounts listed in the Table 4-1, foamed, cured in 30 minutes, and formed a polyurethane filled ballast layer.

By using of H-XP3 type regular high pressure spraying machine, a first reaction system components comprising DESMODUR K630 and BAYTEC 52BC003 were sprayed onto a surface of the polyurethane-filled ballast layer in 30 seconds according to the amounts listed in the Table 4-2, cured in 10 minutes, and formed a polyurethane external protective layer. The physical and mechanical properties of the polyurethane external protective layer were listed in Table 4-2.

TABLE 4-1

| Item | Unit | Material speciality/test standard | Formula 4-1 | Formula 4-2 |
|---|---|---|---|---|
| Bayflex 12BX012 | weight parts | Temperature 25-30° C. | 100 | 100 |
| Desmodur PA 09 | weight parts | Temperature 25-30° C. | 44 | 44 |
| Solkane ® 365/227 | weight parts | Pre-mix in 12BX012 | 4 | 0 |
| Physical properties | | | | |
| Foam density | $kg/m^3$ | DIN EN ISO 845 | 200 | 300 |
| Hardness | Shore A | DIN 53505 | 39 | 59 |
| Tensile strength | KPa | DIN EN ISO 527 | 372 | 831 |
| Elongation at break | % | DIN EN ISO 527 | 125 | 134 |
| Tear strength | kN/m | DIN 53515 | 5.9 | 7.7 |
| Compress strength (10%) | KPa | DIN EN ISO 178 | 17 | 61 |

TABLE 4-2

| Item | Unit | Material speciality/ test standard | Formula 4-3 |
|---|---|---|---|
| BAYTEC 52BC003 | volume parts | 25° C. | 100 |
| Desmodur K630 | volume parts | 25° C. | 100 |
| Physical properties | | | |
| Density | $kg/m^3$ | DIN EN ISO 845 | 950 |
| Hardness | Shore A | DIN 53505 | 95 |
| Tensile strength | MPa | DIN EN ISO 527 | 16.5 |
| Elongation at break | % | DIN EN ISO 527 | 500 |
| Tear strength | kN/m | DIN 53515 | 86 |
| Resilience | % | DIN 53512 | 35 |

The prepared polyurethane ballast layer comprised a polyurethane-filled ballast layer and polyurethane external protective layer.

The polyurethane-filled ballast layer was obtained by a foaming process of the polyether polyol system. The ballasts were fixed in the polyether polyurethane foam. The polyurethane-filled ballast layer possessed good physical and mechanical properties. The polyurethane external protective layer could separate the polyurethane-filled ballast layer with the outside environment, and significantly reduced the water immersion probabilities of the polyether polyurethane foam comprised in the polyurethane filled ballast layer. Furthermore, the polyurethane-filled ballast layer was well adhered to the polyurethane external protective layer, due to the fact that the chemical properties' of the first reaction system was close to the second reaction system. Therefore, the obtained polyurethane ballast layer was an integrated whole structure.

The polyurethane ballast layer could be used to extend the maintenance cycle of the the ballast track bed, because it possessed a good physical and mechanical properties, good stability and durability. In particular, the polyurethane ballast layer provided in Example 4 was suitable for the railway track bed in the high humidity area.

Although the present invention is illustrated through Examples, it is not limited by these Examples in any way. Without departing from the spirit and scope of this invention, those skilled in the art can make any modifications and alternatives. And the protection of this invention is based on the scope defined by the claims of this application.

The invention claimed is:

1. A method comprising providing a polyurethane-filled ballast layer spraying a first reaction system onto a surface of the polyurethane-filled ballast layer to form a polyurethane external protective layer, wherein the first reaction system comprises 1a) one or more polyisocyanates having a general formula $R(NCO)_n$, wherein, R is selected from the group consisting of an aliphatic alkyl group comprising 2 to 18 carbon atoms, an aromatic alkyl group comprising 6 to 15 carbon atoms and an arylated alkyl group comprising 8-15 carbon atoms, and n is an integer from 2 to 4;

1b) one or more polyether polyols and/or amine terminated polyether, having an average molecular weight of more than 200 and a functionality from 2 to 6;

1c) one or more extender; and 1d) from 0 to 0.5% by weight of one or more blowing agent, based on 100% by weight of 1b) and 1c);

wherein the tensile strength of the polyurethane external protective layer is from 4 to 20 MPa.

2. The method as claimed in claim 1, wherein the density of the polyurethane external protective layer is from 0.6 to 1.5 $g/cm^3$, the hardness of the polyurethane external protective layer is from 10 to 90 Shore A, and the elongation at break of the polyurethane external protective layer is from 100 to 550%.

3. The method as claimed in claim 1, wherein the polyurethane-filled ballast layer comprises ballasts and polyurethane foam filled among the ballasts, wherein the polyurethane foam comprises a reaction product of a second reaction system comprising the reaction components of 2a) one or more polyisocyanates having a general formula R(NCO)n, wherein, R is selected from the group consisting of an aliphatic alkyl group comprising from 2 to 18 carbon atoms, an aromatic alkyl group comprising from 6 to 15 carbon atoms, and an arylated alkyl group comprising from 8 to 15 carbon atoms, n is an integer from 2 to 4;

2b) one or more polyols selected from the group consisting of polyether polyol, polyester polyol, polycarbonate polyol, polycaprolactone polyol and polytetrahydrofuran polyol;

2c) one or more extender; and 2d) from 0.3 to 4.5% by weight of one or more blowing agent, based on 100% by weight of 2b) and 2c);

wherein the elongation at break of the polyurethane foam is from 120 to 400%.

4. The method as claimed in claim 3, wherein the density of the polyurethane foam is from 0.02 to 0.5 g/cm$^3$, the hardness of the polyurethane foam is from 5 to 60 Asker C, and the tensile strength of the polyurethane foam is from 0.2 to 5 MPa.

5. A railway track bed comprising a polyurethane-filled ballast layer and a polyurethane external protective layer, wherein the polyurethane external protective layer comprises a reaction product of a first reaction system, wherein the first reaction system is sprayed onto a surface of the polyurethane-filled ballast layer, and wherein the first reaction system comprises the following reaction components:

1a) one or more polyisocyanates having a general formula R(NCO)n, wherein, R is selected from the group consisting of an aliphatic alkyl group comprising from 2 to 18 carbon atoms, an aromatic alkyl group comprising from 6 to 15 carbon atoms, and an arylated alkyl group comprising from 8 to 15 carbon atoms, n is an integer from 2 to 4;

1b) one or more polyether polyols and/or amine terminated polyether, having an average molecular weight of greater than 200 and a functionality from 2 to 6;

1c) one or more extender; and 1d) from 0 to 0.5% by weight of one or more blowing agent, based on 100% by weight of 1b) and 1c);

wherein the tensile strength of the polyurethane external protective layer is from 4 to 20 MPa.

6. The railway track bed as claimed in claim 5, wherein the polyurethane external protective layer has a density of from 0.6 to 1.5 g/cm$^3$, a hardness of from 10 to 90 Shore A, and an elongation at break of from 100 to 550%.

7. The railway track bed as claimed in claim 5, wherein the polyurethane-filled ballast layer comprises ballasts and polyurethane foam filled among the ballasts, wherein the polyurethane foam comprises a reaction product of a second reaction system which comprises the reaction components of 2a) one or more polyisocyanates having a general formula R(NCO)n, wherein, R is selected from the group consisting of an aliphatic alkyl group comprising from 2 to 18 carbon atoms, an aromatic alkyl group comprising from 6 to 15 carbon atoms, and an arylated alkyl group comprising from 8 to 15 carbon atoms, n is an integer from 2 to 4;

2b) one or more polyols, selected from the group consisting of polyether polyol, polyester polyol, polycarbonate polyol, polycaprolactone polyol and polytetrahydrofuran polyol;

2c) one or more extender; and 2d) from 0.3 to 4.5% by weight of one or more blowing agent, based on 100% by weight of 2b) and 2c);

wherein the polyurethane foam has an elongation at break of from 120 to 400%.

8. The railway track bed as claimed in claim 7, wherein the polyurethane foam has a density of from 0.02 to 0.5 g/cm$^3$, a hardness of from 5 to 60 Asker C, and a tensile strength of from 0.2 to 5 MPa.

9. The railway track bed as claimed in claim 5 further comprising a railway road bed, wherein the polyurethane-filled ballast layer and the polyurethane external protective layers is positioned on top of the railway road bed.

10. A method of constructing a railway track bed as claimed in claim 5, which comprises providing a railway road bed, and applying the polyurethane-filled ballast layer and the polyurethane external protective layer to a railway road bed.

* * * * *